US008833007B2

(12) United States Patent
Tillery et al.

(10) Patent No.: US 8,833,007 B2
(45) Date of Patent: Sep. 16, 2014

(54) MODULAR FLOOR TILE CONNECTABLE WITH ANOTHER MODULAR FLOOR TILE TO FORM AN AREA MAT THAT RESISTS SEPARATION DURING USE

(71) Applicants: William Leon Tillery, Ringgold, GA (US); Walter Robb Andersen, Dalton, GA (US)

(72) Inventors: William Leon Tillery, Ringgold, GA (US); Walter Robb Andersen, Dalton, GA (US)

(73) Assignee: MMI Anderson Company, LLC, Dalton, GA (US)

( * ) Notice: Subject to any disclaimer, the term of this patent is extended or adjusted under 35 U.S.C. 154(b) by 0 days.

(21) Appl. No.: 13/763,113

(22) Filed: Feb. 8, 2013

(65) Prior Publication Data

US 2013/0291474 A1 Nov. 7, 2013

Related U.S. Application Data

(63) Continuation-in-part of application No. 13/464,341, filed on May 4, 2012.

(51) Int. Cl.
*E04F 11/16* (2006.01)

(52) U.S. Cl.
USPC ..... 52/177; 52/574

(58) Field of Classification Search
USPC ..... 52/177, 716.1, 574, 591.3
See application file for complete search history.

(56) References Cited

U.S. PATENT DOCUMENTS

| | | | | |
|---|---|---|---|---|
| 3,172,343 | A | 3/1965 | Jacobs | |
| 3,657,852 | A * | 4/1972 | Worthington et al. | 52/591.3 |
| 4,087,948 | A | 5/1978 | Mellor | |
| 4,133,481 | A | 1/1979 | Bennett | |
| 4,287,693 | A | 9/1981 | Collette | |
| 4,361,614 | A | 11/1982 | Moffitt | |
| 5,052,158 | A | 10/1991 | D'Luzansky | |
| 6,526,705 | B1 | 3/2003 | MacDonald | |
| 6,802,159 | B1 | 10/2004 | Kotler | |
| 6,966,155 | B2 | 11/2005 | Nevlson | |
| 7,114,298 | B2 | 10/2006 | Kotler | |
| 7,571,573 | B2 | 8/2009 | Moller | |
| 7,690,160 | B2 | 4/2010 | Moller | |
| 7,698,859 | B2 | 4/2010 | Sansano | |
| 7,797,890 | B2 | 9/2010 | Thrush et al. | |
| D653,893 | S | 2/2012 | Huss et al. | |
| 8,166,722 | B2 | 5/2012 | Moller | |
| 2007/0289244 | A1 | 12/2007 | Haney et al. | |
| 2010/0083608 | A1 * | 4/2010 | Moller, Jr. | 52/716.1 |

OTHER PUBLICATIONS

Mountville Mills Anti-Fatigue Mat Collection, www.mountville.com/productcategory.aspx (Products, Anti-Fatigue Collection), Mountville Mills, Inc., 1729 S. Davis Road, LaGrange, GA 30241.

(Continued)

*Primary Examiner* — Basil Katcheves
(74) *Attorney, Agent, or Firm* — Baker Donelson Bearman Caldwell & Berkowitz PC

(57) ABSTRACT

A modular floor tile comprising a substrate having a first land with a support surface and first and second perimeter portions each defining a second land with a surface recessed relative to the support surface, the first and second perimeter portions each defining spaced-apart T-lugs and alternating T-recesses, whereby two tiles join together by the T-recesses of a first tile receiving respective T-lugs of a second tile, and the support surface supporting footwear remote from the second land to avoid scuffing against the joined T-lugs and T-recesses which resist separation of adjacent tiles during use.

28 Claims, 10 Drawing Sheets

(56) References Cited

OTHER PUBLICATIONS

Anti-Fatigue Mat Materials on About.com Ergonomics, http://ergonomics.about.com/od/antifatiguemats/tp/Anti-Fatigue_Mat-Materials.htm, (2009).

Invigorator Anti-Fatigue Mat, matsmatsmats.com, http://www.matsmatsmats.com/commercial-industrial/anti-fatigure/invigorator-mat . . . (2 pages)(2000).

Mountville Mills 2010 Catalog, Mountville Mills, Inc., 1729 S. Davis Road, LaGrange, GA 30241 (2010).

Anti-Fatigue Mats, matsmatsmats.com, http://www.matsmatsmats.com/commercial-industrial/anti-fatigure/invigorator-mat . . . (4 pages)(2000).

* cited by examiner

MODULAR FLOOR TILE CONNECTABLE WITH ANOTHER MODULAR FLOOR TILE TO FORM AN AREA MAT THAT RESISTS SEPARATION DURING USE

FIELD OF THE INVENTION

The present invention relates to floor mats and anti-fatigue mats. More particularly, the invention relates to modular floor tiles that connect together to cover an area as a mat with improved dovetail lugs and recesses to resist separation of the modular floor tiles during use.

BACKGROUND OF THE INVENTION

Persons who have work or other needs for standing for long periods of time or for walking on hard floor surfaces such as concrete or tile often experience problems with their feet and with fatigue. To accommodate such work needs and assist with reducing fatigue from standing or walking on hard surfaces, anti-fatigue mats have been developed to provide a cushioned surface on which to stand or walk. There are various types of anti-fatigue mats, including foam, gel-filled, foam rubber, and hard rubber. Each type provides alternative benefits and features, but generally, each type of mat provides a cushioned or resilient body to soften the surface on which the person stands or walks. For small area workstations, for example, at a machinery control station or a photocopy machine, single small area mats are satisfactory. However, there are often needs to cover a larger areas, such as a small room or hallway.

Individual stations may use a foam mat or a gel mat. Foam mats are readily manufactured but provide moderate support and moderate anti-fatigue while gel-filled offer superior support and anti-fatigue benefits. Foam rubber mats are suitable for industrial applications. Hard rubber mats may have interlocking pieces to assemble as a runner or to cover a large area.

While hard rubber mats with interlocking features may connect together to cover a large area, such may be unsatisfactory as lacking anti-fatigue properties. Foam mats having a resilient or cushioned base and an overlaid attached rubber surface are readily manufactured but have the drawback of not interlocking together satisfactorily. Die cutting of such foam mat to form the connecting members on side edges causes cupping in the side walls, and thereby reduces the effectiveness of the connection between adjacent tiles. Scuffing of footwear or wheeled traffic may also cause the rubber layer to delaminate or separate from the foam base.

Our pending U.S. patent application Ser. No. 12/646,341 discloses modular rubber/foam-backed anti-fatigue tiles that connect together to cover an area as an anti-fatigue mat while the novel structure enables the mat to resist delamination of the rubber from the foam back during use of the tiles. It has been found that the interconnected modular tiles however tend to separate one from another during use of the mat in industrial areas with wheeled carrier devices such as carts, hand-trucks, and the like, rolling across the mat. Accordingly, there is a need in the art for an improved interconnection of modular floor tiles to form large area mats that resist separation during use. It is to such that the present invention is directed.

SUMMARY OF THE INVENTION

The present invention meets the need in the art by providing a floor tile, comprising a substrate with a length and a width exceeding a depth and having a back surface and an opposing top layer. The top layer has a central portion and at least opposing first and second marginal perimeter portions. The central portion defines a first land with a support surface. The first and second marginal perimeter portions each define a respective second land with a surface recessed relative to the support surface. The at least opposing first and second marginal perimeter portions each have a respective side edge from which a plurality of T-lugs project in spaced-apart relation and alternating with a plurality of T-recesses defined in the respective side edge. The T-recesses are configured for mating reception of the T-lugs of another floor tile. The T-lug comprises a main leg projecting from the side edge, a cross-leg substantially perpendicular to the main leg at a distal end thereof, and two end legs extending at opposite ends of the cross-leg. Each of the two end legs defining an abutment extending towards the side edge and the T-recess defining a pair of notches each confirming in shape to abutment. A plurality of the floor tiles join together by the T-recesses of a first one of the floor tiles matingly receiving a respective one of the T-lugs projecting from a second one of the floor tiles, with each notch receiving a respective one of the abutments whereby the contacting edges of the abutment and the notch resist relative movement of the first and second floor tiles. The support surfaces of adjacent connected floor tiles supports footwear or wheeled traffic of a user thereon remote from the second land of the marginal perimeter portions and the matingly connected T-lugs and T-recesses resist separation of adjacent floor tiles during use.

In another aspect, the present invention provides a method of forming a floor tile, comprising the steps of:

(a) providing a substrate with a length and a width exceeding a depth and having a back surface and an opposing top layer with a central portion and at least opposing first and second marginal perimeter portions;

(b) defining in the central portion a first land with a support surface;

(c) defining in each of the first and second marginal perimeter portions a respective second land with a surface recessed relative to the support surface;

(d) providing the at least opposing first and second marginal perimeter portions each with a plurality of T-lugs projecting from a respective side edge in spaced-apart relation and alternating with a plurality of T-recesses defined in the respective side edge and configured for mating reception of the T-lugs of another floor tile, each of the T-lugs comprising:

a main leg projecting from the side edge, a cross-leg substantially perpendicular to the main leg at a distal end thereof, and two end legs extending at opposite ends of the cross-leg, each of the two end legs defining an abutment extending towards the side edge and the T-recess defining a pair of notches each conforming in shape to an abutment;

the alternating T-lugs and T-recesses of the first marginal perimeter portion offset relative to the alternating T-lugs and T-recesses of the second marginal perimeter portion, whereby a T-recess in the first marginal perimeter portion opposes a T-lug in the second marginal perimeter portion;

whereby a first floor tile matingly connects to an adjacent second floor tile upon the T-recesses of a first one of the floor tiles matingly receiving a respective one of the T-lugs projecting from a second one of the floor tiles, with each notch receiving a respective one of the abutments whereby the contacting edges of the abutment and the notch resist relative movement of the first and second floor tiles, whereby the support surfaces of adjacent connected tiles support footwear or wheeled traffic of a user thereon remote from the second land of the marginal perimeter portions while the matingly engaged T-lugs and T-recesses resist separation of adjacent tiles during use.

In yet another aspect, the present invention provides an area mat, comprising a plurality of modular floor tiles that being selectively joined together selectively cover an area larger than an individual one of the modular tiles. Each modular floor tile comprises a substrate with a length and a width exceeding a depth and having a back surface and an opposing top layer. The top layer has a central portion and at least opposing first and second marginal perimeter portions. The central portion defines a first land with a support surface. The first and second marginal perimeter portions each define a respective second land with a surface recessed relative to the support surface. The at least opposing first and second marginal perimeter portions each have a respective side edge from which a plurality of T-lugs project in spaced-apart relation and alternating with a plurality of T-recesses defined in the respective side edge. The T-recesses are configured for mating reception of the T-lugs of another floor tile. The T-lug comprises a main leg projecting from the side edge, a cross-leg substantially perpendicular to the main leg at a distal end thereof, and two end legs extending at opposite ends of the cross-leg. Each of the two end legs defining an abutment extending towards the side edge and the T-recess defining a pair of notches each conforming in shape to an abutment. A plurality of the floor tiles join together by the T-recesses of a first one of the floor tiles matingly receiving a respective one of the T-lugs projecting from a second one of the floor tiles, with each notch receiving a respective one of the abutments whereby the contacting edges of the abutment and the notch resist relative movement of the first and second floor tiles. The support surfaces of adjacent connected floor tiles supports footwear or wheeled traffic of a user thereon remote from the second land of the marginal perimeter portions and the matingly connected T-lugs and T-recesses resist separation of adjacent floor tiles during use.

Objects, features and advantages of the invention will become more apparent upon a reading of the following detailed description in conjunction with the drawings and the claims.

DETAILED DESCRIPTION

Figure 1:
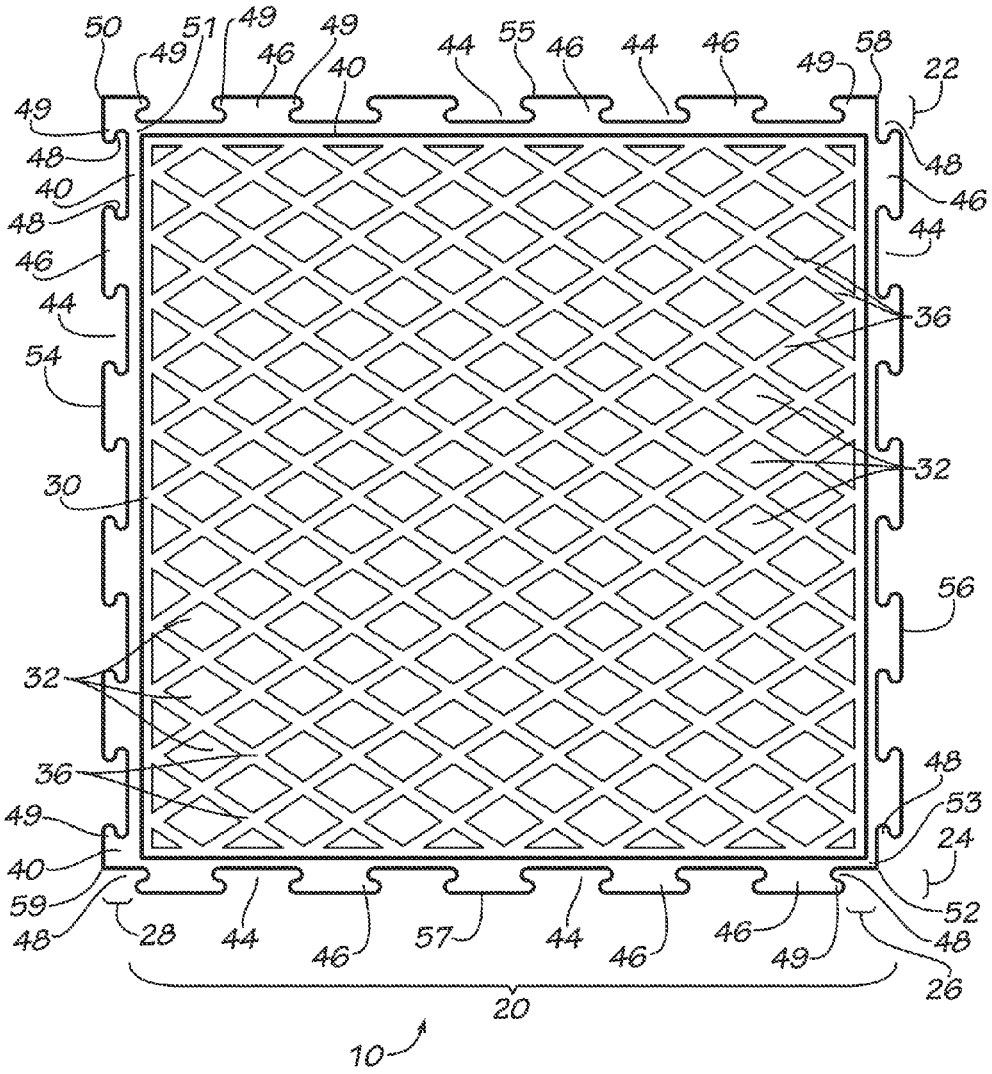
FIG. 1 illustrates in top plan view an embodiment of a modular floor tile in accordance with the present invention.
Figure 2:
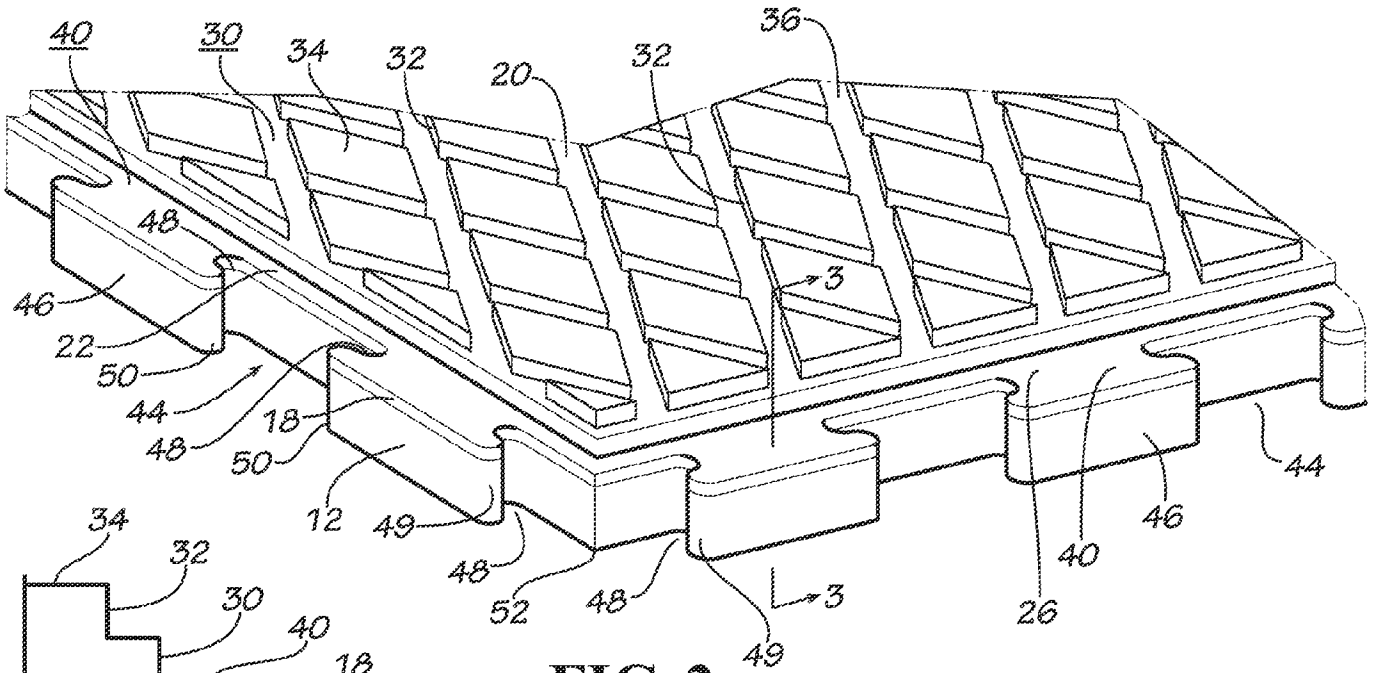
FIG. 2 illustrates a detailed perspective view of a portion of the modular floor tile shown in FIG. 1.

With reference now to the drawings, in which like parts have like identifiers, FIG. 1 illustrates in top plan view an embodiment of a layered floor tile 10 in accordance with the present invention. FIG. 2 illustrates a detailed perspective view of a portion of the tile 10. The tile 10 in the illustrated embodiment includes a foam substrate 12 with a length and a width that exceeds a foam depth 14 and having a back surface 16. A molded rubber layer 18 attaches, such as during vulcanization, to the foam substrate 12 opposing the back surface 16. The rubber layer 18 includes a central portion 20 and at least opposing first and second marginal perimeter portions 22, 24. The illustrated embodiment includes opposing third and fourth marginal perimeter portions 26, 28.

The central portion 20 defines a land 30. The land 30 has a support surface 34 for a purpose discussed below. In the illustrated embodiment, a plurality of spaced-apart cleats 32 extend upwardly to respective distal surfaces, that cooperatively define the support surface 34. As shown in FIG. 1, the spaced-apart cleats 32 define channels 36. The illustrated cleats 32 are diamond-shaped (for interior cleats and triangular for perimeter cleats), but may be configured as other shapes, such as squares, ovals, circles, lands, or other patterns, for defining the support surface for a purpose discussed below. In an alternate embodiment, the land 30 has a support surface not interrupted by channels 36. Alternatively, the support surface 34 may be textured, dimpled, corrugated, embossed, pebbled, defined with holes, ribs, have a grit-top, or raised cleat.

With continuing reference to FIGS. 1 and 2, the first and second marginal perimeter portions 22, 24 each define a respective second land 40 with a surface recessed relative to the distal support surfaces 34 of the cleats 32. In the illustrated embodiment, the first and second marginal perimeter portions each define matingly engageable connectors to join adjacent ones of the tiles together. In the illustrated embodiment, an edge of the first marginal perimeter portion 22 defines at least one lug-receiving recess 44. The illustrated embodiment includes a plurality of the lug-receiving recesses 44 disposed in spaced relation. An edge of the opposing second marginal perimeter portion 24 defines at least one projecting lug 46 configured for mating reception by the lug-receiving recess 44. In the illustrated embodiment, the second marginal perimeter portion 24 defines a plurality of projecting lugs 46 in spaced-relation.

In the illustrated embodiment, the first and second marginal perimeter portions 22, 24 each define a plurality of alternating lug-receiving recesses 44 and projecting lugs 46. Further, the alternating lug-receiving recesses 44 and projecting lugs 46 in the first marginal perimeter portion 22 are off-set relative to the alternating lug-receiving recesses 44 and projecting lugs 46 in the second marginal perimeter portion 24, so that a lug-receiving recess in the first marginal perimeter portion opposes a projecting lug in the second marginal perimeter portion.

A plurality of the anti-fatigue tiles 10 gainfully join together to form an area-covering mat. The tiles 10 interconnect by the lug-receiving recess 44 of a first one of the laminated anti-fatigue tiles 10 matingly receiving a projecting lug 46 of a second one of the laminated anti-fatigue tiles. The tiles 10 thereby connect together to form a single connected mat for covering a large area, such as a room or to form a runner of the tiles for a hallway or aisle.

The lug-receiving recess 44 and the projecting lug 46 as illustrated have dovetail shapes for mating connection thereof. In the illustrated embodiment, the recess 44 and the lug 46 cooperatively define arcuate opposing ends. The lug-receiving recess 44 defines concave arcuate ends 48 while the lug 46 defines convex or outwardly bowed arcuate ends 49. In an alternate embodiment (not illustrated), the lugs 46 define tapered opposing flags that are generally narrower than a circumference that defines the arcuate ends 48 of the recess 44 to facilitate the mating connection of the recess and the lug.

Further, the tile 10 in the illustrated embodiment has an orientation that facilitates mating engagement with other tiles, as discussed below. The tile 10 accomplishes the orientation with a projecting male element 50 on a corner 51 and an opposing female receiving element 52 on an opposing corner 53. The projecting element 50 is defined by the adjacent arcuate ends 49 on the corner 51, which ends 49 are residual portions of a respective projecting lug 46 on a first side 54 and a second side 55 normal to the first side. The receiving element 52 is defined by the adjacent arcuate ends 48 on the corner 52, which ends 48 are residual portions of the land adjacent a respective recess 44 on a third side 56 and a fourth side 57 normal to the third side. The alternate opposing corners 58, 59 combined the residual portions of one end 48 and one end 49 for the end lug 46 and end recess 44 at the respective corner. An alternate embodiment of the tile 10 lacks the orienting projecting elements 50 and receiving element 51, and rather has the combined ends 48, 49 of the recess 44 and end projecting lug 46 on the respective sides normal to each other.

Figure 3:
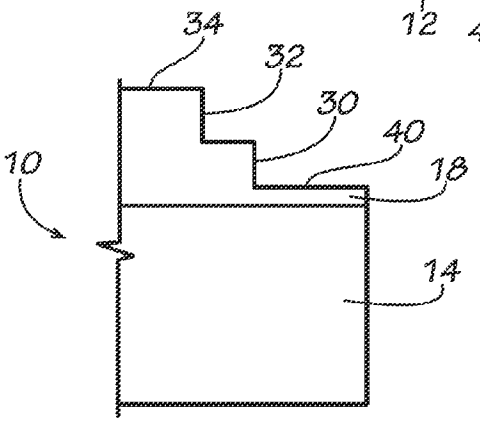
FIG. 3 illustrates in cross-sectional view the modular floor tile taken along line 3-3 of FIG. 2.

FIG. 3 illustrates in cross-sectional view features of the rubber/foam-backed laminated tile 10 taken along line 3-3 of FIG. 2. The foam substrate 14 provides a cushion backing for the tile 10 to rest on a floor surface. The rubber layer 18 laminates by vulcanization to the foam substrate. The perimeter portions 22, 24 define the land 40 that is recessed relative to the support surfaces 34 of the cleats 32 extending from the land 30. The perimeter portions 22, 24 define the lug-receiving recesses 44 and lugs 46 for connecting adjacent tiles 10.

Figure 4:
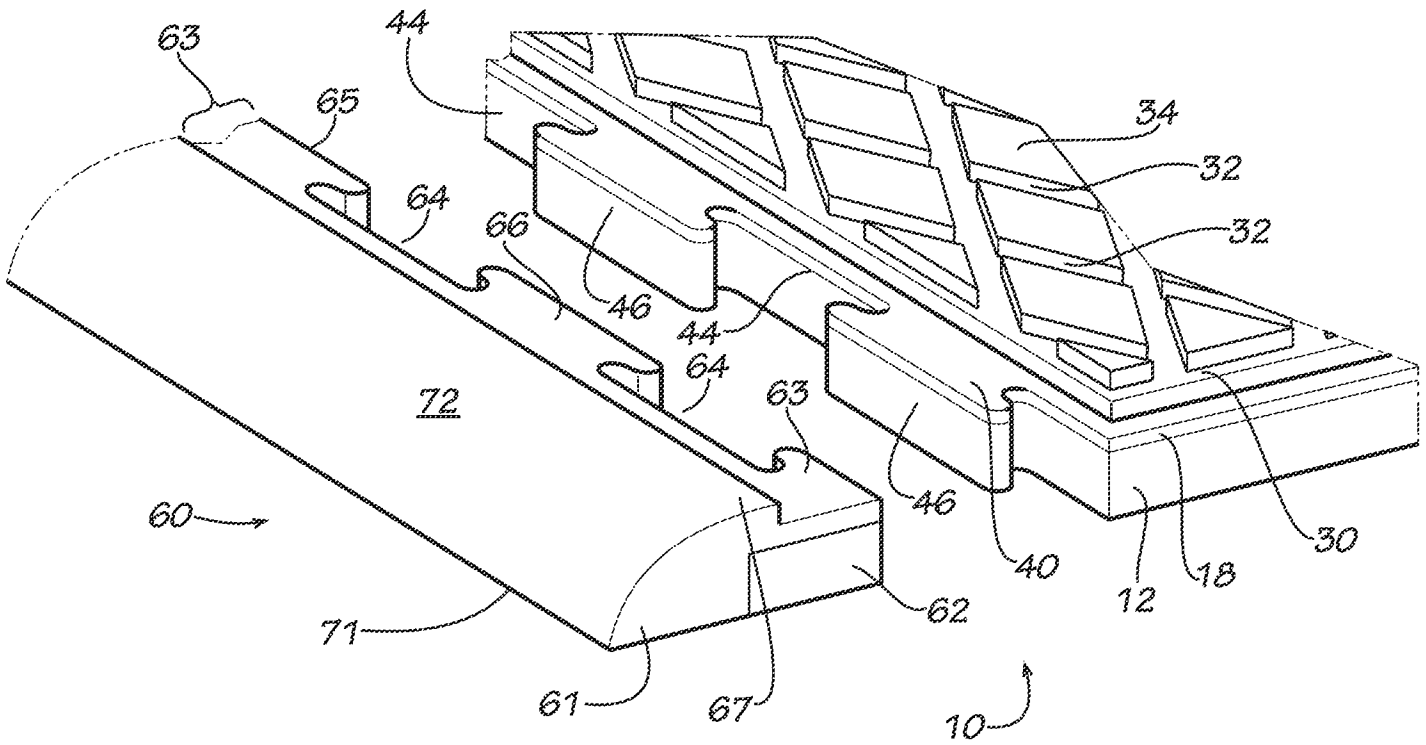
FIG. 4 illustrates a perimeter band member selectively attachable to the edge of the modular floor tile to define a tapered side edge trim surface for the tile or for a mat having a plurality of interconnected tiles.
Figure 7:
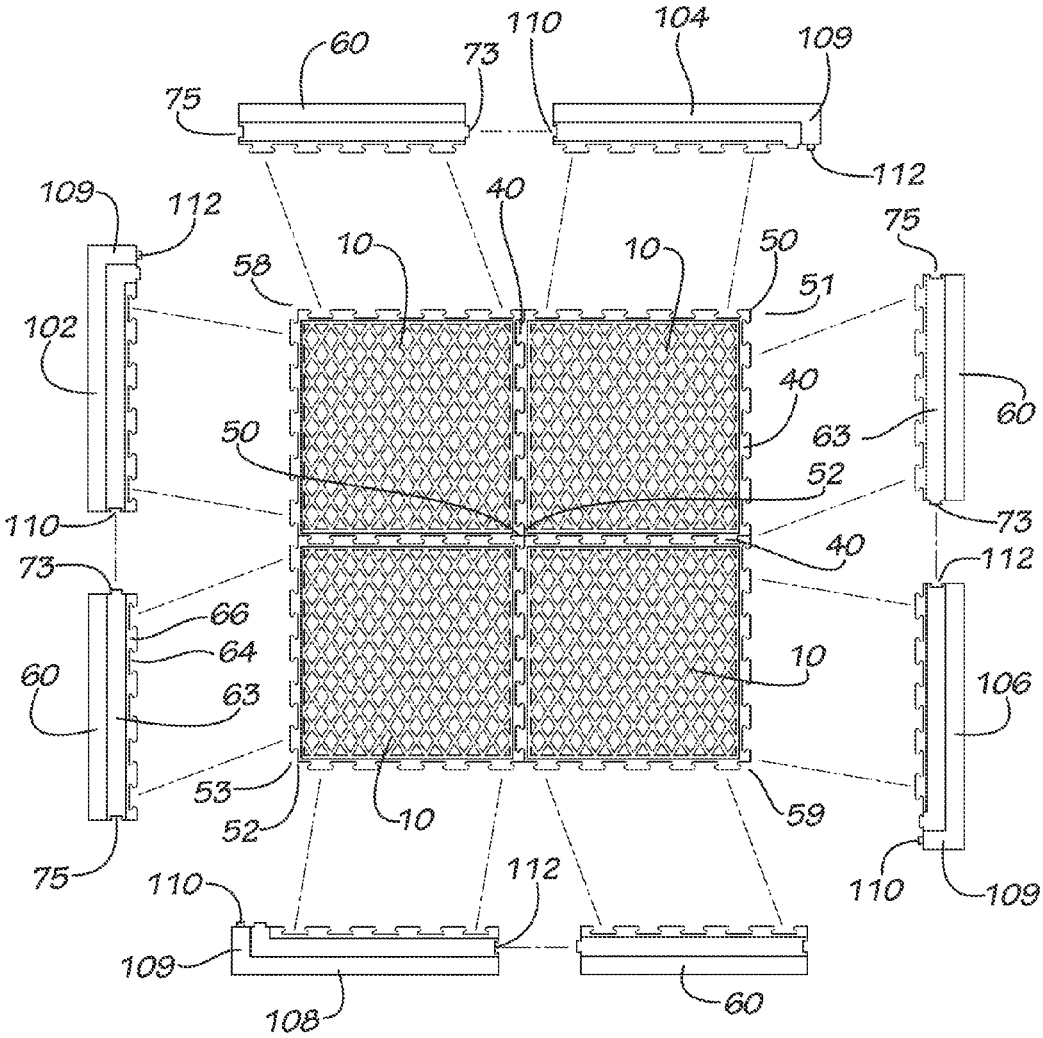
FIG. 7 illustrates a plurality of tiles connected together to define a mat with perimeter band members that define side edge trim for the mat.

FIG. 4 illustrates an elongated perimeter band member 60 selectively attachable to one of the marginal perimeter portions (22, 24, 26, or 28) as appropriate to define a finished edge for the tile 10 or for an assembly of a plurality of the tiles 10 to cover a large area. The elongated band member 60 includes a rubber layer 61 that attaches during vulcanization to a foam pad 62. The member 60 includes an edge portion 63 with a surface and a lateral edge 65. The lateral edge 65 is configured for being engaged to a respective perimeter portion 22, 24, 26, or 28. To that end, the edge 65 defines (i) at least one projecting lug 66 configured for being received by the lug-receiving recess 44 in a respective marginal perimeter portion or (ii) at least one lug-receiving recess 64 configured for receiving the projecting lug 46 of a respective marginal perimeter portion. The edge 65 in the illustrated embodiment includes alternating lug-receiving recesses 64 and lugs 66 for aligned mating attachment to a respective marginal perimeter portion 22, 24, 26, or 28 of the tile 10. The member 60 includes a support surface 67 on an extending portion lateral of the edge portion 63. The surface 63 is recessed relative to the support surface 67. The thickness of the edge portion 63 equals that of the land 40 of the tile 10 for cooperative horizontal alignment of the surfaces of the edge portion 63 and the land 40. Similarly, the support surface 67 extends above the edge portion 63 a distance equal to the support surface 34 relative to the land 40. The thickness of the band member 60 tapers from the support surface 67 laterally as a sloped surface 72 to a lateral edge 71. As illustrated in FIG. 7, the edge portion 63 defines in one end of the band member 60 a projecting lug 73 and in an opposing end defines a recess 75.

It is to be appreciated that the tapered edges on two opposing sides may be molded and formed into the tile 10 such as during the vulcanization molding process for a tile having the two opposing marginal portions 22, 24, for example, for forming a fixed width tile such as for a runner.

Figure 5:
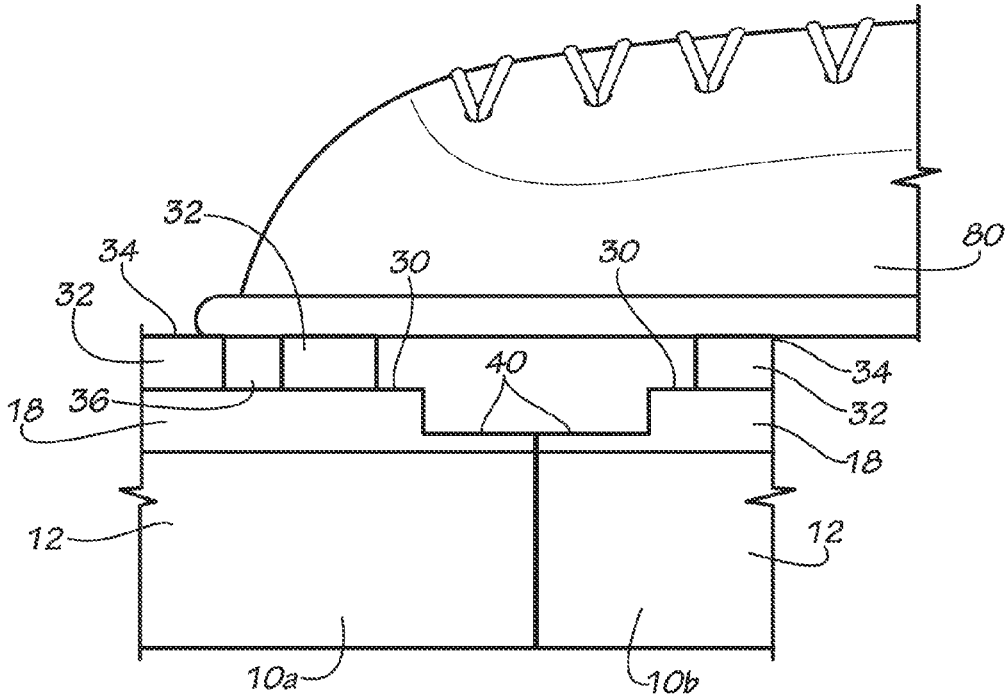
FIG. 5 illustrates a detailed cross-sectional view of a pair of the floor tiles connected together and in use with footwear of a user supported away from the connection of the adjacent tiles.

FIG. 5 illustrates a detailed cross-sectional view of a pair of the rubber/foam-backed laminated tiles 10*a*, 10*b* connected together as a mat and in use for covering a floor surface. The support surfaces 34 of the cleats 32 support, for example, wheeled traffic or as illustrated, footwear 80, of a user vertically spaced and remote from the lug/recess connections in the land 40 of the marginal perimeter portions 22 (or 24, 26 or 28) of the adjacent tiles 10. In the illustrative embodiment, the surface of the second land 40 is recessed ⅛ inch vertically below the support surface 34. Other vertical spacing may be satisfactory. The support surfaces 34 and the recessed land 40 cooperatively restrict the footwear 80 (or wheeled traffic) from scuffing against the upper edges or portions of the rubber layer at the joined connection of the projecting lugs 46 received in the recesses 44, so that the rubber layer 18 is not delaminated from the foam substrate 14. With reference to FIG. 4, the support surface 67 of the band member 60 on the side of the tile 10 aligns horizontally with the support surface 34 on the tile. The recessed surfaces of the edge portion 63 and the land 40 align for recessing the connection of the recesses 44 and lugs 66 and of the lugs 46 and recesses 64.

Figure 6:
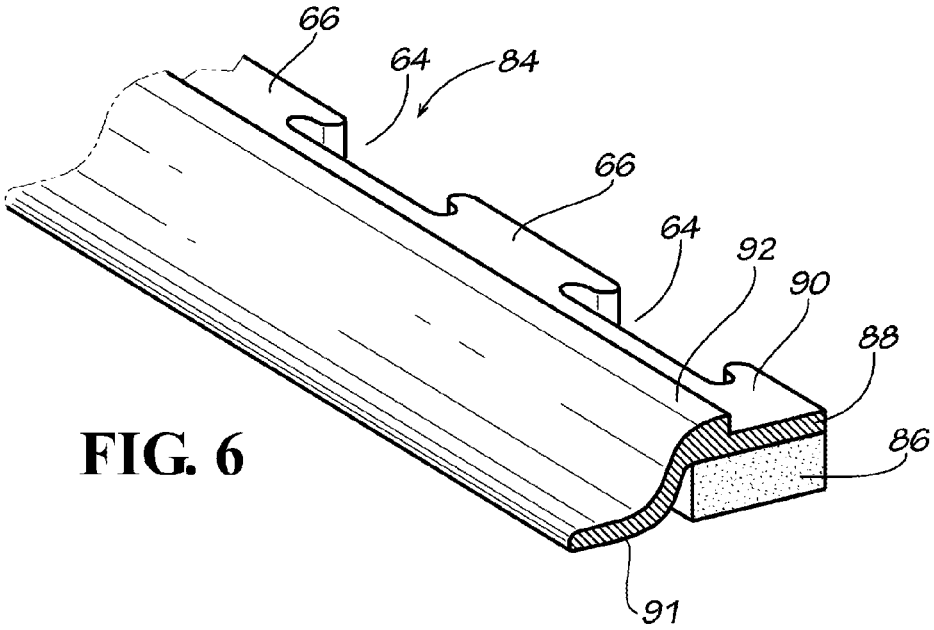
FIG. 6 illustrates an alternate embodiment of a perimeter band member for selectively attaching to the edge of the floor tile to define a tapered side edge trim surface for the tile or for a mat having a plurality of interconnected tiles.

FIG. 6 illustrates in perspective view a perimeter band member 84 as an alternate embodiment defining a trimming side edge of the tile 10 or of a mat of connected tiles. The member 84 includes a foam base 86 and rubber layer 88 that defines a surface 90 and raised support surface 82. A portion 91 of the rubber layer 88 extends laterally such as a tongue or a tapered flap along a side edge of the tile 10. The portion 91 provides a transition between a floor surface and the tile 10. An edge of the member 84 defines the alternating recesses 64 and lugs 66, as discussed above, for connecting the member 84 to the tiles 10.

An alternate embodiment of the perimeter band member lacks the tapered portion 91, and rather, defines a squared-off lateral edge. The trim member of this alternate embodiment is useful for defining an edge of mat disposed on an aisle that does not have cross traffic across the mat, such as between opposing storage shelves, and not requiring a sloped entry to the mat.

FIG. 7 illustrates a top plan view of four tiles 10 connected together by interconnecting opposing recesses 44 and lugs 46 to define an area mat 100. The land surfaces 40 between adjacent tiles are recessed relative to the support surfaces 34. The outer side edges of the area mat 100 are finished with respective trim band members 60 (or 84) discussed above and with corner edge members 102, 104, 106, and 108. Corner edge members 102, 104 and band members 60 are shown exploded from the sides of the tiles to which they connect. The corner edge members 102, 104, 106, and 108 are structurally the same as the band member 60 (or 84), but a distal end portion generally 109 of each defines a 90° lateral bend to define the corner. In the illustrated embodiment, the corner edge members 102, 104, 106, and 108 terminate at the bend portion with a projecting lug 110 in the edge portion 63. An opposing distal end defines a recess 112 in the edge portion 63. The lug 110 and the recess 112 are structurally the same as the lug 73 and the recess 75 for interlinking with band members 60. The lug 110 matingly connects to the recess 75 of the band member 60; the recess 112 receives the lug 73 of another of the band members 60. For larger area mats, additional band members 60 are used. In this way, a perimeter border for the area mat 100 assembles from the four corner edge members 102, 104, 106, and 108, and two of the side bands 60. It is to be appreciated that the alternating recesses 64 and projecting lugs 66 in the members commence with either a recess or a lug, for mating connection to a respective side of the tile 10.

As discussed above with reference to FIG. 1, the projecting element 50 on the corner 51 of a tile 10*a* abuts the receiving element 52 on the corner 53 of an adjacent tile 10*b*. The combined ends 48, 49 on the alternating corners 58, 59 of the tiles 10*c*, 10*d*, respectively, abut the adjacent corners 51, 53 as illustrated in FIG. 7.

Figure 8:
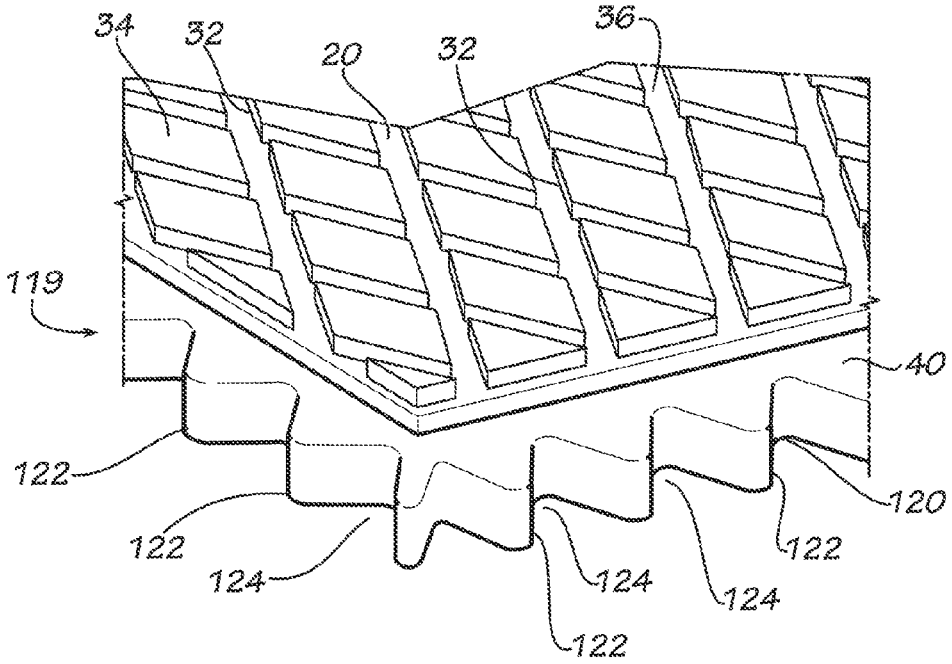
FIG. 8 illustrates a detailed perspective view of a portion of an alternate embodiment of a modular floor tile.

As explained above, the marginal perimeter portions 22, 24, 26 and 28 define the surface 40 recessed relative to the support surface 34. A pair of tiles 10 connect on adjacent perimeter portions. FIG. 8 illustrates a portion of an alternate embodiment 119 of the tile 10. The marginal perimeter portions of the tile 119 define sawtooth edges 120 of projecting points 122 and recesses 124. A pair of the tiles 119 matingly connect on the opposing sawtooth edges 120. To maintain alignment of tiles in a mat of adjacent tiles, one perimeter edge commences with a point 122 and an opposing perimeter edge the point is off-set in order to be received by the opposing aligned recess 124 in the adjacent tile. In an alternate embodiment, the sawtooth edge 120 is curved, arcuate, or sinusoidal, for mating abutment of perimeter portions of adjacent tiles 10. Similarly, the perimeter band members 60, 84 may gainfully use the sawtooth edge 120 for joining an adjacent sawtooth edge perimeter portion of the tile.

Figure 9:
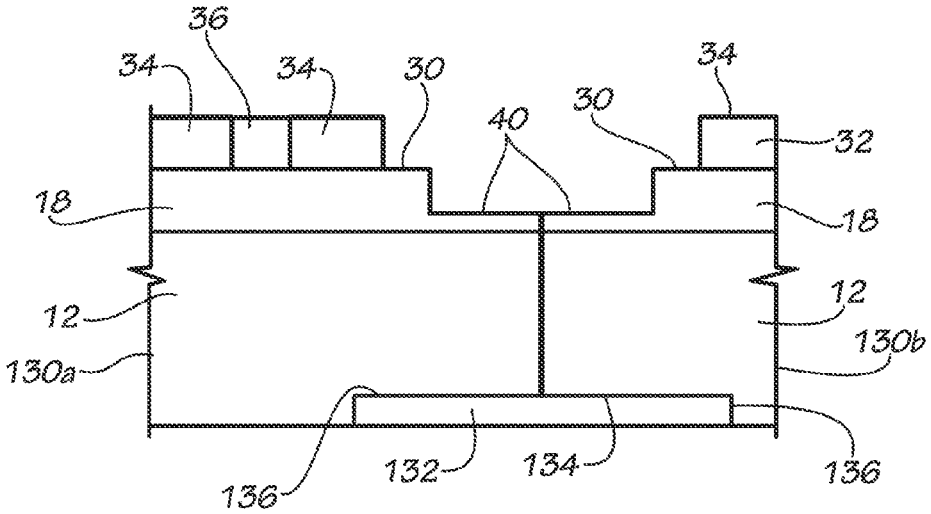
FIG. 9 illustrates in cross-sectional view a pair of modular floor tiles in an alternate embodiment.

FIG. 9 illustrates an alternate embodiment tile 130 in which the perimeter portions 22, 24, 26, and 28 have an elongated strip 132 as a connector for joining abutting perimeter portions of adjacent tiles. The elongated strip 132 has an adhesive surface 134 such as a tape, for adheringly overlapping areas of the adjacent surfaces of the perimeter portions of the tiles. In the illustrated embodiment of the tile 130, the back surface defines a recessed channel 136 which receives the adhesive strip 132. The strip 132 overlaps the perimeters of the adjacent tiles 130. The adhesive strip 132 may similarly be adhered on the surfaces 40 overlapping the joint between the adjacent tiles 130*a*, 130*b*. Similarly, the perimeter band members 60, 84 may gainfully connect to the perimeter portion of an adjacent tile using the adhesive strip 132.

Figure 10:
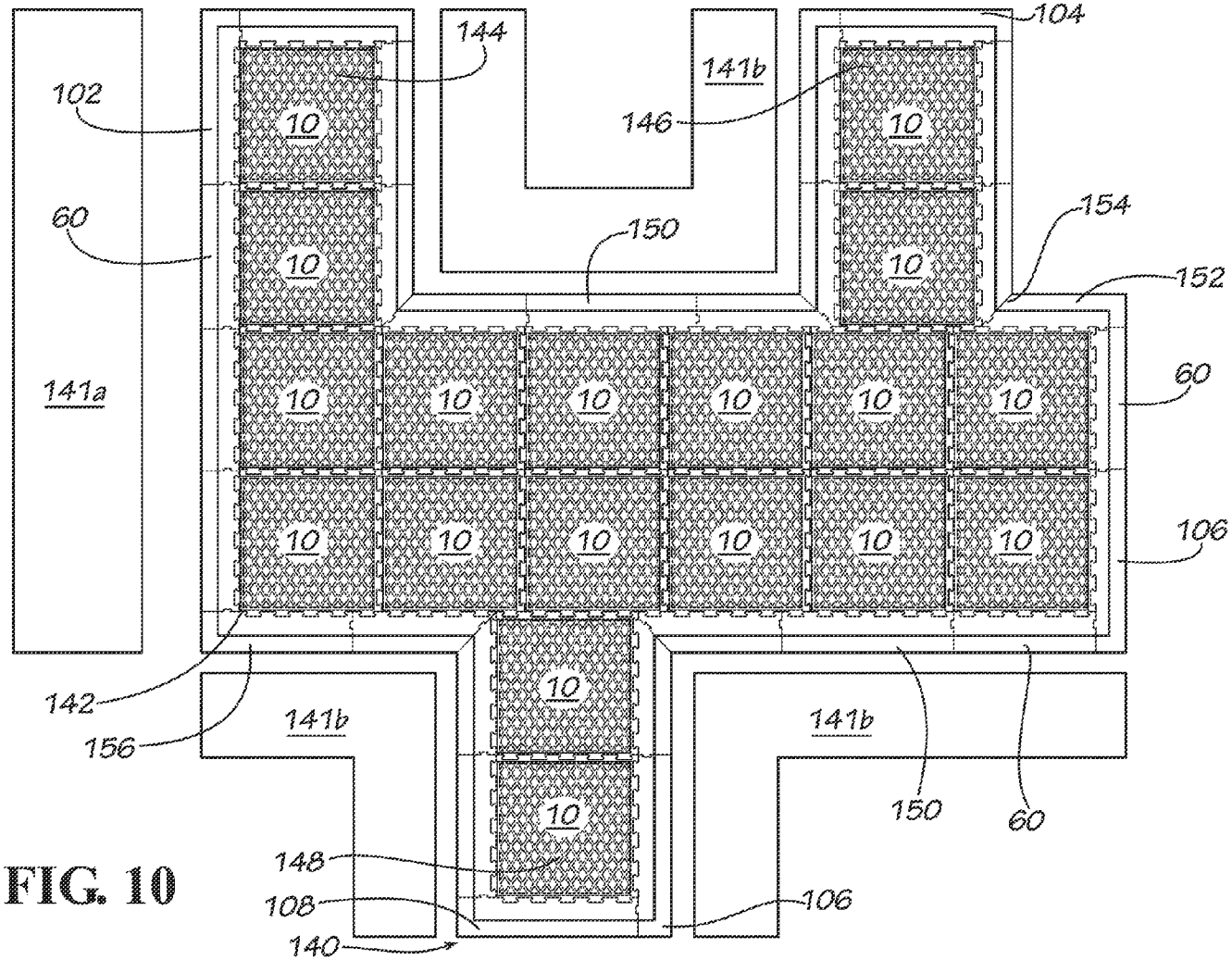
FIG. 10 illustrates a plan view of a floor mat assembled from a plurality of tiles and side-edge trim members customized for a particular facility as an illustrative application of the present invention.

FIG. 10 provides an illustrative example of a custom mat 140 for covering a floor area in a particular facility installation, for example, a prescription fulfillment area of a drug-store having a counter area 141*a* and shelves 141*b* from which stock may be obtained. To facilitate standing during work, the floor area is provide with an anti-fatigue 140 that assembles from a plurality of the tiles 10 and the side trim edge members (60, 84, 012, 104, 106, and 108) discussed above. The mat 140 has a main area 142 and three (3) stems 144, 146, 148 extending from the main area. In this illustration, the stem 146 is offset relative to the tiles 10 from which the stem 146 extends. Similarly, the stem 148 is offset relative to the tile from which it extends. To accommodate such offset, custom length side trim members are required. These include a special length straight side member 150, a corner end member 152 having a 45° (mitered) end 154 defining a portion of a bend in the perimeter of two joined tiles 10, and a corner member 156 with a 90° bend defining a normal corner. The straight side member 150 is longer than a standard straight side member 60, but may be shorter as appropriate for a particular custom installation. The corner member 154 is shorter in length than a standard corner member 106, but may be shorter as appropriate for a particular custom installation.

The tile 10 in the illustrated embodiment is manufactured from sheets of foam and rubber sized for the particular tile. With reference to FIGS. 1 and 2, a sheet or substrate of foam 12 is placed in a vulcanizing mold. The rubber layer 18 is overlaid on the foam substrate 12. The mold defines the central portion 20 with the cleats 32 as well as the marginal perimeter portions 22, 24 (and in the illustrated embodiment 26, 28) with the second lands 40 recessed relative to the support surfaces 34. During the vulcanization heat and pressure process, the rubber layer 18 conforms to the mold definitions for the central portion and the perimeter portions and laminates to the foam substrate 12 opposing the back surface 16.

The blank of the vulcanized rubber/foam floor tile is removed from the mold and placed on a cutting apparatus for cutting marginal portions of the blank away by forming the lug-receiving recesses 44 and projecting lugs 46 on the marginal perimeter portions. The cutting tool is preferably a water-jet apparatus. The water jet operates as a cutting blade to cut through the rubber and foam layers. The water-jet cuts through the laminated tile 10 without compressing the foam substrate 12. Other cutting devices that apply a pressure or load to the tile during the cutting process compresses the foam. The compressed foam bulges outwardly, which bulge is then cut by the cutter. When the compression is released, the foam retracts, and the cut-off portion of the foam forms a cavity or cup in the side wall of the laminated tile. Side walls with such cavity or cup are unsatisfactory, as resulting in weakened lug-receiving recesses and lugs, such that an assembly of tiles 10 are insufficiently joined together to resist separation under foot or wheeled traffic. In the illustrated embodiment, the lug-receiving recesses 44 and the projecting lugs 46 are cut from the surface of the second land 40 through the foam depth 14. An alternate embodiment may cut less than through the entire thickness, and with a lateral cutting device, separate a plug and leave a shelf extending from the side wall.

The method described above may gainfully be followed to manufacture a plurality of the tiles 10 simultaneously. The foam substrate 12 and the rubber layer 18 are sized for the number of tiles 10 to be cut from laminated blank. The discrete tiles 10 are separated from the laminated blank by simultaneously forming the lug-receiving recess 44 for a first of the plurality of anti-fatigue tiles and the projecting lug 46 for a second of the plurality of anti-fatigue tiles adjacent to the first anti-fatigue tile. This is accomplished by a cut line made by the water-jet, by which the adjacent anti-fatigue tiles are separated one from another.

The edge members 60, 84, 102, 104, 106, and 108, are similarly manufactured in a respective mold by vulcanizing a rubber layer to a foam member.

The special length edge members 150, 152, and 154, for example, may likewise be defined in the blank and cut apart with the water-jet.

The floor tile 10 of the present invention is disclosed in an illustrative embodiment as having a base substrate 12 of a foam material or sheet and the top layer 18 of a rubber sheet that upon vulcanization attaches to the foam while forming the structure of the central portion and the perimeter portions, whereby the feature of the perimeter portions 22, 24 (and 26, 28) having the mating recesses and projections 44, 46 with the surface 40 recessed relative to the support surface 34, facilitates the tiles joined together to form the mat and to resist delamination of the top layer and the base substrate during use of the mat. It is to be appreciated that layered tiles may gainfully be made of conventional mat materials and include the features of the present invention. This includes vinyl sponge tiles of a vinyl layer attached to a PVC foam (closed or open cell), in various thicknesses for selective cushioning, rubber top surface or layer that is heat bonded to PVC foam base (open cell or closed cell), PVC or other resilient sheet members attached, heat-bonded, fusion-bonded, adhered such as with an adhesive, glue, or joining material, laminated or otherwise connected to a base cushioning substrate such as foam, urethane sponge layers (such as providing highly resistant cushioning), the base substrate formed by curing a liquid foam material that adheres to the top layer, as well as other conventional materials that may be layered together to form a floor tile. Such tiles may gainfully apply the feature of the surface on perimeter portions recessed relative to the support surface 34 on which a user walks to resist delamination of the layers of the tile during use. The edge members 60, 84, 102, 104, 106, and 106, are similarly manufactured.

FIG. 5 illustrates a portion of two adjacent joined tiles 10*a*, 10*b*, with footwear 80 supported on the support surfaces 34 for use as an anti-fatigue mat covering an area on a hard floor surface. The footwear 80 of a user is kept vertically spaced and remote from the lug/recess connections in the second land 40 of the marginal perimeter portions 22 (or 24, 26 or 28) of the adjacent tiles 10. The support surfaces 34 and the recessed land 40 thereby cooperatively restrict the footwear 80 (or wheeled traffic) from scuffing against the upper edges or portions of the rubber layer at the joined connection of the projecting lugs 46 received in the recesses 44, so that the rubber layer 18 is not delaminated from the foam substrate 14.

The channels 36 may allow flow of water from the tile, for wet environments. Also, an alternate embodiment may define a plurality of through holes.

With reference to FIG. 7, a plurality of the tiles 10 readily connect to define the area mat 100. Corner edge members 102, 104, 106, and 108 interconnect with side members 60 and with respective edges of the tiles 10 to define a perimeter trim for the area mat 100.

With reference to FIG. 8, adjacent tiles 119 matingly connect on perimeter portions by receiving points 122 in recesses 124.

As shown in FIG. 9, adjacent tiles in an alternate embodiment attach together with the adhesive strip 132.

The tile 10 in the illustrated embodiment is 18×18 inches square, with a foam substrate 12 of ⅝ inch, and a rubber layer of ⅛ inch. The recessed land 40 has a width of 1 inch. The recesses 44 and projecting tabs 46 are on 3½ inch centers, permitting incremental 3½ inch offsets for stems extending from a mat, as discussed above. The tile 10 however may be formed in selected other sizes, such as may be conventional in the art, with the base and top layers of selected thickness suitable for the particular application for a floor mat, and differences in center spacing for the recesses and projecting tabs.

The present disclosure accordingly describes alternate connectors (mating recesses and projections, adhesive tape, and the like) for joining perimeter portions of adjacent tiles to define the area mat while the support surfaces 34 keep footwear of a user (and wheels of rolling devices) vertically spaced and remote from the second land 40 of the marginal perimeter portions of the adjacent tile. The support surfaces 34 and the recessed land 40 thereby cooperatively restrict the footwear (or wheeled traffic) from scuffing against the upper edges or portions of the top layer at the joined connection of the perimeter portions so that the top layer 18 is not delaminated from the base substrate 14.

Figure 11:
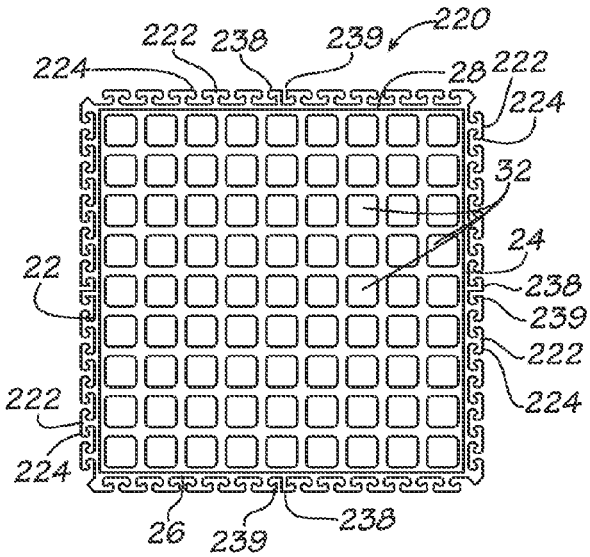
FIG. 11 illustrates in top plan view an alternate embodiment of a modular floor tile featuring T-lugs and mating T-recesses for connecting adjacent ones of the modular floor tiles in accordance with the present invention.

FIG. 11 illustrates in top plan view an alternate embodiment of a modular floor tile 220 having the foam substrate 12 and rubber top layer 18, as discussed above. The modular floor tile 220 features T-lugs 222 and mating T-recesses 224 in side edges of the modular floor tile. The T-lugs 222 and T-recesses 224 have dovetail shapes for mating connection. The T-lugs 222 and T-recesses 224 provide mating interconnection of adjacent floor tiles 220 for forming a mat of a plurality of the floor tiles. The illustrated embodiment includes the at least two opposing first and second marginal perimeter portions 22, 24 that each define the respective second land 40 recessed relative to the support surface 34 of the central portion 20. The first and second marginal perimeter portions 22, 24 each have a respective side edge from which a plurality of the T-lugs 222 project in spaced-apart relation and alternating with a plurality of the T-recesses 224. The T-lugs 222 and the T-recesses 224 are configured for mating reception. A plurality of the floor tiles 220 join together by the T-recesses 224 of a first one of the floor tiles 220 matingly receiving a respective one of the T-lugs 222 projecting from a second one of the floor tiles 220. The illustrated embodiment of the modular tile 220 is square in shape, but may be other shapes, and defines a center floor tile for interconnecting with a plurality of floor tiles to form a mat. In the illustrated embodiment, each of the marginal perimeter portions 22, 24, 26 and 28 include the side edges defining the alternating plurality of T-lugs 222 and T-recesses 224.

Figure 12:
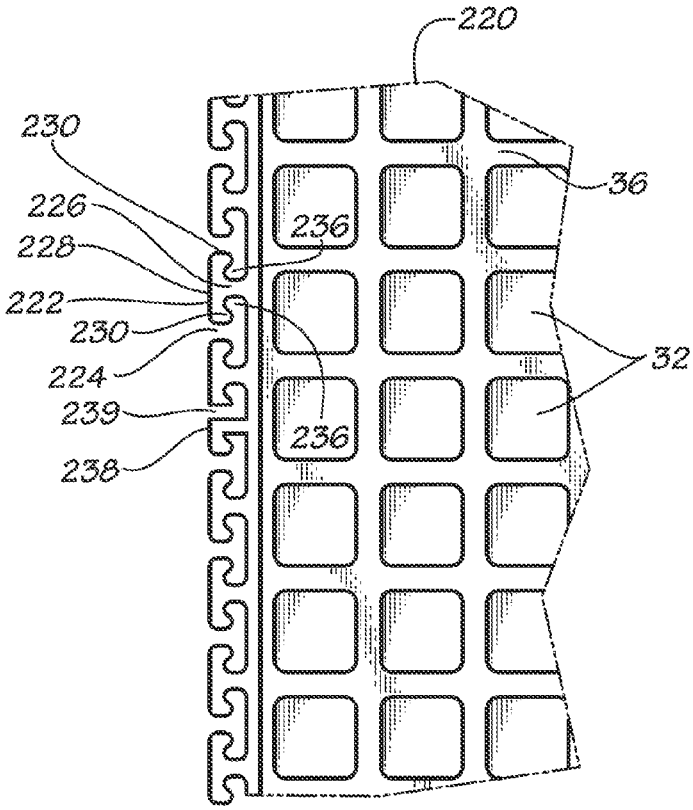
FIG. 12 illustrates in detailed enlarged view the T-lugs and mating T-recesses of the modular floor tile shown in FIG. 11.

FIG. 12 illustrates in detailed enlarged view the T-lugs 222 and mating T-recesses 224 of the floor tiles 120 shown in FIG. 11. Preferably, the T-lugs 222 and the T-recesses 224 have conforming shapes for mating connection of respective one of the T-lugs 222 received within a respective one of the T-recesses 224.

The T-lug 222 has a main leg 226 projecting from the side edge and a cross leg 228 substantially perpendicular to the main leg 226 at a distal end. Two end legs 230 extend at opposite ends of the cross leg 228. The end legs 230 extend inwardly towards the side edge of the marginal perimeter portion of the floor tile 120. In the illustrated embodiment, the end leg has an arcuate distal end 232. The end legs 230 thereby define curved abutments 234 at the distal end 232. The T-recess 224 defines a curved notch 236. The abutment 234 of the end leg 230 of a first floor tile 220 nests into the notch 234 of a respective one of the T-recesses 124 of a second floor tile 220. The contacting edges of the curved abutment 234 and the notch 236 resist relative movement of the interconnected first and second floor tiles 220.

It is to be appreciated with respect to FIG. 12, that the T-lug 222 has the main leg 226 projecting from the side edge and the cross-leg 228 disposed substantially perpendicular to the main leg 226 at a distal end. The cross-leg 228 defines two notches 236 on respective opposing sides of the main leg 226. The cross-leg 228 with defined notches 236 thereby provides the abutment 234 on distal ends 232 as projecting end legs in the opposing distal end portions of the cross-member 228. In the illustrated embodiment, the notch 236 is arcuate and thereby defines the arcuate projecting end leg 234. The arcuate end leg 234 of the T-lug 222 of a second floor tile 220 nests into the notch 236 of one of the T-lugs of a first floor tile.

In the illustrated embodiment, the T-lugs 222 and T-recesses 224 are disposed on 1 and ½ inch centers. The T-lugs 222 extend ⅝ inches from an edge defined by a face 237 of the T-recess 124. The main leg 226 has a width of ¼ inch, and the cross-leg 228 has a length of 1 and 3/16 inch. The end legs 230 have a length of ⅜ inch from an outer edge of the cross-leg to an inward distal extent of the end leg into the T-recess 224. The floor tile in the illustrated embodiment is substantially square with sides having lengths of 18 and ⅝ inch. The foam substrate 12 has a thickness of ⅝ inch and rubber top layer 18 has a thickness at a side edge of ⅛ inch. The modular tile 220 however may be formed in selected other sizes, such as may be conventional in the art, with the base and top layers of selected thickness suitable for the particular application for a floor mat, and differences in center spacing for the recesses and projecting tabs.

Returning to FIG. 11, the alternating T-lugs 222 and T-recesses 224 of the first marginal perimeter portion 22 are offset relative to the alternating T-lugs and T-recesses of the opposing marginal perimeter portion 24. In this way, a T-recess 224 in the first marginal perimeter portion 22 opposes a T-lug 222 in the second marginal perimeter portion. This facilitates maintaining alignment of a plurality of modular floor tiles 220 when being interconnected with other tiles to form a mat.

Figure 13:
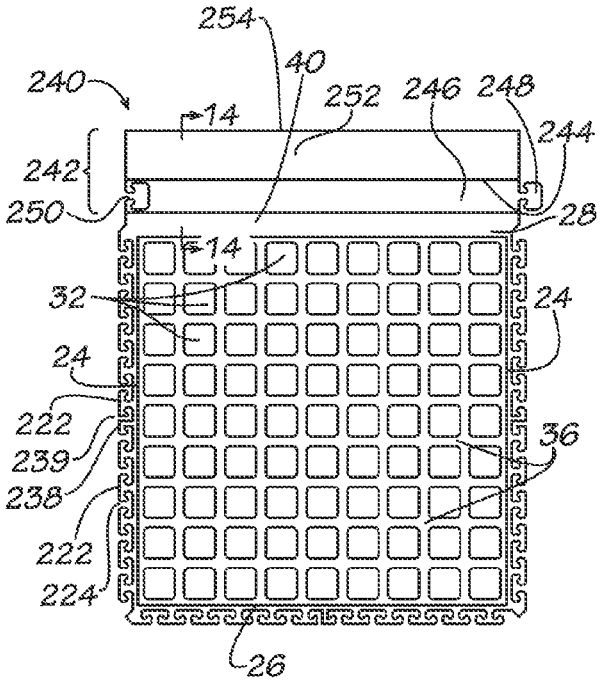
FIG. 13 illustrates in top plan view a modular floor tile with an integral side perimeter member.

FIG. 13 illustrates in top plan view a modular side floor tile 240. In this embodiment, the first, second and third marginal perimeter portions 22, 24 and 26 each include the side edges having the plurality of T-lugs 222 and T-recesses 224 in alternating spaced apart relation, for mating connection of the modular side floor tile 240 with an adjacent modular side floor tile such as tile 220 or another tile 240. It is thus to be appreciated that the marginal perimeter portion 26 may gainfully be joined to one of the modular floor tiles 220 to make a mat having a width of more than two of the tiles, as discussed below.

The marginal perimeter portion 28 includes a perimeter border generally 242. The perimeter border 242 in the illustrated embodiment has a width of 3 ½ inches. The perimeter border 242 includes a step 244 that extends in a first direction at an outer edge of the marginal perimeter portion 28 to define a perimeter upper surface 246 spaced from the land 40. In the illustrated embodiment, the upper surface 246 is substantially co-plainer with the upper surfaces 34 of the central portion 20. A lug 248 projects from one end of the step 244. The opposing end of the step 244 defines a recess 250. The lug 248 and the recess 250 have conforming dovetail shapes for mating connection of the lug with the recess 250 of an adjacent side floor tile 240. Similarly, the recess 250 receives the lug 248 of yet another second lateral adjacent side floor tile 240 when interlocking a plurality of the tiles to form a large area mat.

Figure 14:
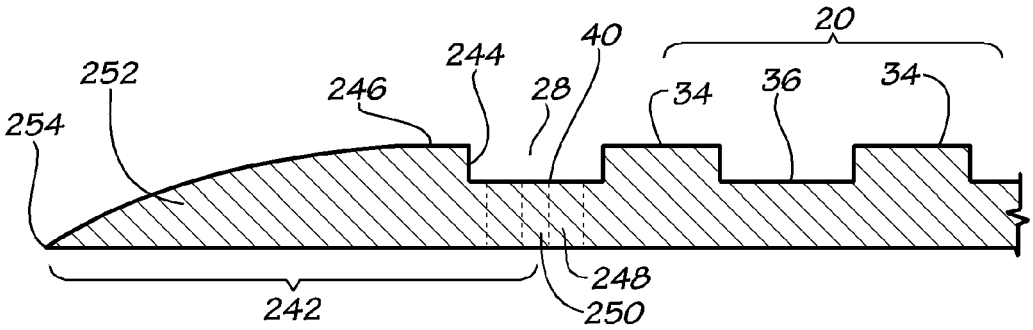
FIG. 14 illustrates in side elevational view the modular floor tile shown in FIG. 13 taken along line 14-14.

FIG. 14 is a side elevational view of a portion of the perimeter side 28 of the modular side tile 240 taken along line 14-14. As illustrated in FIG. 14, the step 244 defines the upper surface 246 substantially co-plainer with the support surfaces 34 of the central portion 20 and spaced vertically from the land 40. The step 244 extends laterally into a perimeter band 252. The perimeter band 252 extends from an outer edge of the step 244 to a distal edge 254. The perimeter band 252 tapers from the upper support surface 246 to the distal edge 254 and thereby has a varying thickness therealong that is less than the depth of the base substrate 12. This defines a sloped surface along an edge of the floor tile 240.

As illustrated in FIG. 11, the marginal perimeter edge portions 22, 24, 26 and 28 further comprise an L-shaped lug 238 projecting from a side edge. As shown in enlarged view in FIG. 12, the L-shaped lug 238 is disposed intermediate the alternating series of T-lugs 222 and T-recesses 224. The T-lug **222*a* next to a back of the L-shaped lug 238 cooperatively defines an L-shaped recess 239. When interlocking adjacent first and second tiles 220 together, the L-shaped recess 239 of the first floor tile receives the L-shaped lug 238 of the second floor tile. It is to be appreciated that due to the offset opposing relation of the T-lugs 222 and T-recesses 224 on opposing perimeter portions 22, 24 (or 26, 28), the L-lug 238 on the perimeter portion 22 opposes the L-shaped recess on the perimeter portion 24**.

Figure 15:
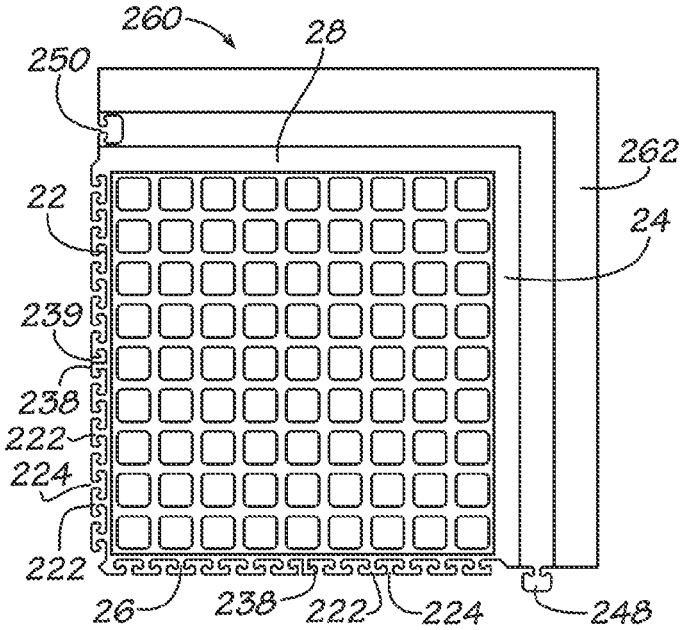
FIG. 15 illustrates in top plan view a modular floor tile with integral longitudinal and transverse side perimeter members.

FIG. 15 illustrates in top plan view a modular corner floor tile 260 with an integral side perimeter border 262. The perimeter border 262 is continuous on a longitudinal side 28 and a transverse side 24 of the modular corner floor tile 260. In this embodiment, the first and third marginal perimeter portions 22, 26 each include the side edges having the plurality of T-lugs 222 and T-recesses 224 in alternating spaced-apart relation, for mating connection of the modular side floor tile 260 with an adjacent modular side floor tile such as tile 220 or tile 240, when interconnecting ones of the tiles 220, 240 and 260 for forming a large-area mat.

The perimeter border 262 has the same structure as the perimeter border 242 but extends on adjacent longitudinal and transvers sides 28, 24 so that the tile 260 define a corner for a large area mat. The perimeter border 262 includes the step 244 at the outer edge of the respective marginal perimeter portion to define the perimeter upper surface 246 spaced from the land 40. A lug 248 projects from one end of the step 244. The opposing end of the step 244 defines the recess 250. The lug 248 and the recess 250 have conforming dovetail shapes for mating connection of the lug with the recess 250 of an adjacent side floor tile 240 or corner floor tile 260. Similarly, the recess 250 receives the lug 248 of yet another second lateral adjacent side floor tile 240 or second corner floor tile 260 when interlocking a plurality of the tiles to form a large area mat.

The tiles 220, 240 and 260 are disclosed in the illustrated embodiment as useful with laminated foam substrates 12 and rubber top layer 18, but may be gainfully used when the tiles are assembled with a single layer or substrate made with a plurality of rubber chips or a rubber sheet that vulcanize to form the unitary tile.

Figure 16:
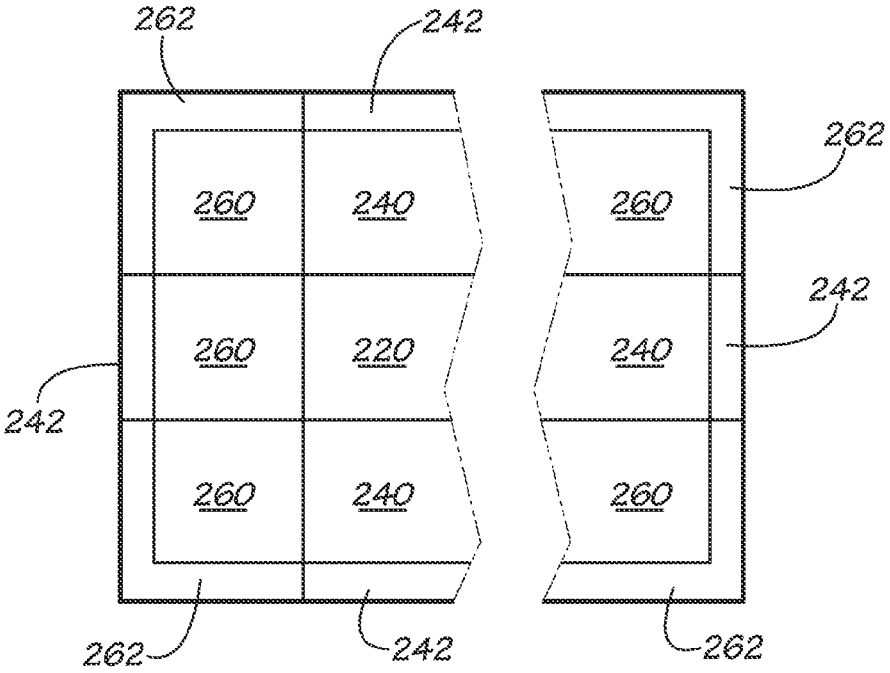
FIG. 16 illustrates in schematic view a large area mat formed by interconnecting the modular floor tiles illustrated in FIGS. 11, 13 and 15.

FIG. 16 illustrates in schematic view the modular floor tiles 220, 240, and 260 interconnected to form a large area mat 270, such as to cover an area or provide an elongated runner mat for a walk way. The tiles 220 define interior tiles of the mat 270; the tiles 240 define side edge tiles for the mat; and the tiles 260 define corners of the mat.

With reference to FIGS. 11, 13, and 15, adjacent side edges of the modular tiles interconnect with the T-recesses 224 of one of the tiles matingly receiving the respective T-lugs 222 of an adjacent tile. The notches 236 in the T-recesses on an edge of one of the modular tiles receives the abutments 234 on the arcuate end legs 232 of the T-lugs 222 on an edge of an adjacent one of the modular tiles. The abutments and the notches cooperatively matingly engage to hold the adjacent tiles together as a mat. During use of the mat, the matingly engaged abutments 234 and notches 236 of the adjacent modular tiles facilitate the T-lugs 222 and T-recesses 224 to remain matingly engaged so that the adjacent modular tiles resist separation when wheeled carts or hand-trucks, or foot traffic, roll across the joint between adjacent tiles.

Although particular embodiments of the invention have been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

What is claimed is:

1. A floor tile, comprising:

a substrate with a length and a width exceeding a depth and having a back surface and an opposing top layer, the top layer having a central portion and at least opposing first and second marginal perimeter portions, the central portion defining a first land with a support surface, the first and second marginal perimeter portions each defining a respective second land with a surface recessed relative to the support surface; and the at least opposing first and second marginal perimeter portions each have a respective side edge from which a plurality of T-lugs project in spaced-apart relation and alternating with a plurality of T-recesses defined in the respective side edge configured for mating reception of the T-lugs of another floor tile, the T-lug comprising:

a main leg projecting from the side edge, a cross-leg substantially perpendicular to the main leg at a distal end thereof, and two end legs extending at opposite ends of the cross-leg, each of the two end legs defining an abutment extending towards the side edge and the T-recess defining a pair of notches each conforming in shape to an abutment, whereby a plurality of the floor tiles join together by the T-recesses of a first one of the floor tiles matingly receiving a respective one of the T-lugs projecting from a second one of the floor tiles, with each notch receiving a respective one of the abutments whereby the contacting edges of the abutment and the notch resist relative movement of the first and second floor tiles, whereby the support surfaces of adjacent connected floor tiles support footwear or wheeled traffic of a user thereon remote from the second land of the marginal perimeter portions.

2. The floor tile as recited in claim 1, wherein the abutment in the end leg has an arcuate edge.

3. The floor tile as recited in claim 1, wherein the T-lug has a main leg projecting from the side edge, a cross-leg substantially perpendicular to the main leg at a distal end thereof, and the cross-leg defines two notches each on a respective opposing side of the main leg.

4. The floor tile as recited in claim 3, wherein adjacent first and second floor tiles being interconnected such that the notch in the T-lug of the first floor tile receives a portion of a respective T-lug of the second floor tile.

5. The floor tile as recited in claim 4, wherein the notch is arcuate adjacent the main leg to define an arcuate projecting end leg in a distal end portion of the cross member, wherein the acruate end leg of the T-lug of the second floor tile nests into the notch of the one of the T-lugs of the first floor tile.

6. The floor tile as recited in claim 1, wherein the alternating T-lugs and T-recesses of the first marginal perimeter portion are off-set relative to the alternating T-lugs and T-recesses of the second marginal perimeter portion, whereby a T-recess in the first marginal perimeter portion opposes a T-lug in the second marginal perimeter portion.

7. The floor tile as recited in claim 1, wherein the T-lug and T-recess have dovetail shapes for mating connection thereof.

8. The floor tile as recited in claim 1, wherein the T-recess and the T-lugs are cut into the marginal perimeter portions of the floor tile by water jet, whereby walls of the respective T-recess and the T-lug are substantially planar without cupping.

9. The floor tile as recited in claim 1, wherein the T-recesses and the T-lugs are cut from the surface of the second land through the depth of the base substrate.

10. The floor tile as recited in claim 1, further comprising a perimeter border configured to define a side edge floor tile in a mat of a plurality of the floor tiles comprising:

a step extending from an outer edge of a third marginal perimeter portion therealong to define a perimeter upper surface substantially coplanar with the upper surface of the central portion; and at least one lug projecting from one end of the step; and the opposing end of the step defining a recess configured receiving a lug at the end of the step of the another floor tile having the perimeter border, whereby a first side edge floor tile matingly connects to an adjacent second side edge floor tile.

11. The floor tile as recited in claim 10, further comprising a perimeter band extending from the outward edge of the step and from a thickness equal to that of the floor tile thereat to a thickness less than the depth of the base substrate, to define a sloped surface along an edge of the floor tile.

12. The floor tile as recited in claim 1, further comprising opposing third and fourth marginal perimeter portions that each define a respective land with a second surface recessed relative to the support surfaces of the central portion and each define a plurality of alternating T-lugs and T-recesses along a side edge thereof.

13. The floor tile as recited in claim 12, wherein the alternating T-lugs and T-recesses in the third marginal perimeter portion are off-set relative to the alternating T- recesses and T-lugs in the fourth marginal perimeter portion, whereby a T-recess in the third marginal perimeter portion opposes a T-lug in the fourth marginal perimeter portion.

14. The floor tile as recited in claim 1, further comprising an L-shaped lug projecting from the side edge of each of the first and second marginal perimeter portions intermediate the alternating T-lugs and T-recesses and the T-lug next to a back of the L-shaped lug defines an L-shaped recess, whereby the L-shaped recess of the first floor tile receives the L-shaped lug of the second floor tile for interlocking adjacent first and second floor tiles together.

15. The floor tile as recited in claim 1, further comprising a perimeter border configured to define a corner floor tile in a mat of a plurality of the floor tiles, comprising:

a step extending along an outer edge of a third marginal perimeter portion and a fourth marginal perimeter portion continuous therefrom and substantially perpendicular thereto to define a corner perimeter upper surface substantially coplanar with the upper surface of the central portion; and at least one lug projecting from one end of the step; and the opposing end of the step defining a recess configured receiving a lug at the end of the step of the another floor tile.

16. The floor tile as recited in claim 15, further comprising a perimeter band extending from the outward edge of the step and from a thickness equal to that of the floor tile thereat to a thickness less than the depth of the base substrate, to define a sloped surface along an edge of the floor tile.

17. The floor tile as recited in claim 1, wherein the substrate has a foam sheet layer and the top layer is a rubber sheet attached together when vulcanizing the rubber sheet.

18. The floor tile as recited in claim 1, wherein the substrate has a foam layer and the top layer laminates to the foam layer.

19. The floor tile as recited in claim 1, wherein the base substrate and the top layer are separate rubber sheets joined together by vulcanization.

20. The floor tile as recited in claim 1, wherein the substate is a rubber sheet.

21. An area mat, comprising a plurality of modular floor tiles for being joined together selectively to cover an area larger than an individual one of the modular floor tiles, each modular floor tile as recited in claim 1.

22. A method of forming a floor tile, comprising the steps of:

(a) providing a substrate with a length and a width exceeding a depth and having a back surface and an opposing top layer with a central portion and at least opposing first and second marginal perimeter portions;

(b) defining in the central portion a first land with a support surface;

(c) defining in each of the first and second marginal perimeter portions a respective second land with a surface recessed relative to the support surface;

(d) providing the at least opposing first and second marginal perimeter portions each with a plurality of T-lugs projecting from a respective side edge in spaced-apart relation and alternating with a plurality of T-recesses defined in the respective side edge and configured for mating reception of the T-lugs of another floor tile, each of the T-lugs comprising:

a main leg projecting from the side edge, a cross-leg substantially perpendicular to the main leg at a distal end thereof, and two end legs extending at opposite ends of the cross-leg, each of the two end legs defining an abutment extending towards the side edge and the T-recess defining a pair of notches each conforming in shape to an abutment;

the alternating T-lugs and T-recesses of the first marginal perimeter portion offset relative to the alternating T-lugs and T-recesses of the second marginal perimeter portion, whereby a T-recess in the first marginal perimeter portion opposes a T-lug in the second marginal perimeter portion;

whereby a first floor tile matingly connects to an adjacent second floor tile upon the T-recesses of a first one of the floor tiles matingly receiving a respective one of the T-lugs projecting from a second one of the floor tiles, with each notch receiving a respective one of the abutments whereby the contacting edges of the abutment and the notch resist relative movement of the first and second floor tiles, whereby the support surfaces of adjacent connected tiles support footwear or wheeled traffic of a user thereon remote from the second land of the marginal perimeter portions while the matingly engaged T-lugs and T-recesses resist separation of adjacent tiles during use.

23. The method as recited in claim 22, further comprising step (e) defining a perimeter border member, comprising:

a step extending from an outer edge of a third marginal perimeter portion therealong with a perimeter upper surface substantially coplanar with the upper surface of the central portion; and at least one lug projecting from one end of the step; and the opposing end of the step defining a recess configured receiving a lug at the end of the step of the another floor tile having the perimeter border.

24. The method as recited in claim 23, further comprising the step of defining a perimeter band extending from the outward edge of the step and from a thickness equal to that of the floor tile thereat to a thickness less than the depth of the base substrate, to define a sloped surface along an edge of the floor tile.

25. The method as recited in claim 22, wherein forming the T-recesses and projecting T-lugs by water jet, whereby walls of the respective lug-receiving recesses and projecting lugs are substantially planar without cupping.

26. The method as recited in claim 22, wherein step (a) further defines opposing third and fourth marginal perimeter portions that each define a respective land with a surface recessed relative to the support surface, and step (d) further forming a plurality of alternating T-lugs and T-recesses in the third and fourth marginal perimeter portions.

27. The method as recited in claim 26, further comprising disposing the alternating T-lugs and T-recesses in the third marginal perimeter portion are off-set relative to the alternating T-lugs and T-recesses in the fourth marginal perimeter portion, whereby a T-recess in the third marginal perimeter portion opposes a respective projecting T-lug in the fourth marginal perimeter portion.

28. The method as recited in claim 22, wherein step (d) comprises defining a first tile and a second adjacent tile in the substrate by forming the T-recesses and T-lugs with a cut line by which the adjacent tiles are separated one from another.

* * * * *